US005581225A

United States Patent [19]

Oh et al.

[11] Patent Number: 5,581,225

[45] Date of Patent: Dec. 3, 1996

[54] ONE-PIECE FEMALE BLADE FUSE WITH HOUSING

[75] Inventors: Seibang Oh, Elk Grove Village; James J. Beckert, Lombard; Theodore W. Humphrey, Arlington Heights; William P. Hendrickson, Westmont, all of Ill.

[73] Assignee: Littelfuse, Inc., Des Plaines, Ill.

[21] Appl. No.: 421,441

[22] Filed: Apr. 20, 1995

[51] Int. Cl.[6] ..... H01H 85/08

[52] U.S. Cl. ..... 337/295; 337/261; 337/263

[58] Field of Search ..... 337/198, 260–265, 337/295, 161; 439/620, 621; 29/623

[56] References Cited

U.S. PATENT DOCUMENTS

| | | | |
|---|---|---|---|
| Re. 33,137 | 12/1989 | Gurevich et al. | 337/255 |
| 2,774,951 | 12/1956 | Kinkaid et al. | 339/258 |
| 2,903,539 | 9/1959 | Matthysse et al. | 200/129 |
| 2,921,287 | 1/1960 | Matthysse et al. | 339/258 |
| 2,996,026 | 8/1961 | Batcheller | 113/119 |
| 3,139,318 | 6/1964 | Binder et al. | 339/256 |
| 3,148,257 | 9/1964 | Feenan et al. | 200/135 |
| 3,288,968 | 11/1966 | Feenan et al. | 200/135 |
| 3,409,867 | 11/1968 | Lessner | 339/258 |
| 3,524,157 | 8/1970 | Salzer | 337/159 |
| 3,550,069 | 12/1970 | Teagno | 339/256 |
| 3,813,626 | 5/1974 | Cetola et al. | 337/245 |
| 3,995,929 | 12/1976 | Girardi et al. | 339/32 |
| 4,099,320 | 7/1978 | Schmidt, Jr. | 29/623 |
| 4,131,869 | 12/1978 | Schmidt, Jr. et al. | 337/264 |
| 4,196,409 | 4/1980 | Juba | 337/198 |
| 4,253,080 | 2/1981 | Howard | 337/159 |
| 4,297,666 | 10/1981 | Asdollahi | 337/163 |
| 4,310,719 | 1/1982 | Cross et al. | 174/94 R |
| 4,319,213 | 3/1982 | Reid | 337/161 |
| 4,344,060 | 8/1982 | Ciesemier et al. | 337/260 |

(List continued on next page.)

FOREIGN PATENT DOCUMENTS

| | | |
|---|---|---|
| 228490A1 | 7/1987 | European Pat. Off. . |
| 633592A1 | 1/1995 | European Pat. Off. . |
| 1312116 | 11/1962 | France . |
| 1567727 | 5/1969 | France . |
| 1615002 | 5/1970 | Germany . |
| 2517069 | 10/1976 | Germany . |
| 2714797 | 2/1979 | Germany . |
| 4340979A1 | 7/1994 | Germany . |
| 626449 | 10/1961 | Italy . |
| 56-53 | 1/1981 | Japan . |
| 57-151141 | 9/1982 | Japan . |
| 57-210537 | 12/1982 | Japan . |
| 59-16054 | 1/1984 | Japan . |

(List continued on next page.)

*Primary Examiner*—Michael W. Phillips
*Assistant Examiner*—Jayprakash N. Gandhi
*Attorney, Agent, or Firm*—Wallenstein & Wagner, Ltd.

[57] ABSTRACT

A female fuse assembly includes a female fuse and a housing. The female fuse includes a first and a second female terminal portion each having a face portion which includes a first end, a second end, a first side, and a second side, includes a first clamping arm and a second clamping arm, includes a first bracing arm and a second bracing arm, and includes a fuse link having a first terminal extension and a second terminal extension, and having a skived region for controlling the resistance between the first and second female terminal portions. The fuse link further includes a first terminal bend and a second terminal bend. The first terminal bend is positioned substantially toward the second end of the first face portion, or vice versa, and the second terminal bend is positioned substantially toward the first end of the second face portion, or vice versa, for increasing the length of the fuse link. The connection between the first female terminal portion and the first terminal extension of the fuse link is positioned toward one end of the first face portion. Similarly, the connection between the second female terminal portion and the second terminal extension of the fuse link is positioned toward one end of the second face portion.

40 Claims, 6 Drawing Sheets

U.S. PATENT DOCUMENTS

| | | | |
|---|---|---|---|
| 4,417,225 | 11/1983 | Muller et al. | 337/198 |
| 4,544,907 | 10/1985 | Takano | 337/262 |
| 4,570,147 | 2/1986 | Ebi | 337/166 |
| 4,604,602 | 8/1986 | Borzoni | 337/264 |
| 4,612,529 | 9/1986 | Gurevich et al. | 337/255 |
| 4,635,023 | 1/1987 | Oh | 337/163 |
| 4,646,052 | 2/1987 | Matsumaga et al. | 337/166 |
| 4,661,793 | 4/1987 | Borzoni | 337/260 |
| 4,670,729 | 6/1987 | Oh | 337/264 |
| 4,672,352 | 6/1987 | Takano | 337/264 |
| 4,685,754 | 8/1987 | Coldren | 339/74 |
| 4,691,981 | 9/1987 | Coldren | 339/252 |
| 4,751,490 | 6/1988 | Hatagishi | 337/295 |
| 4,764,133 | 8/1988 | Kaneko | 439/889 |
| 4,781,628 | 11/1988 | Detter et al. | 439/748 |
| 4,800,358 | 1/1989 | Takenouchi et al. | 337/268 |
| 4,808,962 | 2/1989 | Ikeda | 337/203 |
| 4,810,215 | 3/1989 | Kaneko | 439/865 |
| 4,869,972 | 9/1989 | Hatagishi | 428/647 |
| 4,871,990 | 10/1989 | Ikeda et al. | 337/238 |
| 4,944,084 | 7/1990 | Horibe et al. | 29/623 |
| 4,944,697 | 7/1990 | Dorman | 439/621 |
| 4,958,426 | 9/1990 | Endo et al. | 29/623 |
| 4,975,551 | 12/1990 | Syvertson | 200/144 |
| 4,988,969 | 1/1991 | Gurevich | 337/260 |
| 5,091,712 | 2/1992 | Suuronen | 337/297 |
| 5,139,443 | 8/1992 | Armando | 439/620 |
| 5,147,230 | 9/1992 | Plyler et al. | 439/843 |
| 5,181,866 | 1/1993 | Jerome et al. | 439/850 |
| 5,229,739 | 7/1993 | Oh et al. | 337/290 |
| 5,262,751 | 11/1993 | Kudo et al. | 337/296 |
| 5,281,175 | 1/1994 | Chupak et al. | 439/839 |
| 5,293,147 | 3/1994 | Oh et al. | 337/227 |
| 5,294,906 | 3/1994 | Totsuka et al. | 337/260 |
| 5,346,411 | 9/1994 | Nikkinen | 439/621 |
| 5,350,321 | 9/1994 | Takenouchi | 439/842 |
| 5,357,234 | 10/1994 | Pimpis et al. | 337/246 |
| 5,361,058 | 11/1994 | Mosesian et al. | 337/163 |
| 5,374,590 | 12/1994 | Batdorf et al. | 437/173 |
| 5,416,461 | 5/1995 | Totsuka et al. | 337/261 |

FOREIGN PATENT DOCUMENTS

| | | |
|---|---|---|
| 59-178857 | 11/1984 | Japan . |
| 60-177527 | 9/1985 | Japan . |
| 61-61331 | 3/1986 | Japan . |
| 61-166450 | 10/1986 | Japan . |
| 61-240521 | 10/1986 | Japan . |
| 61-166449 | 10/1986 | Japan . |
| 61-271731 | 12/1986 | Japan . |
| 61-294730 | 12/1986 | Japan . |
| 64-60937 | 3/1989 | Japan . |
| 1-241729 | 9/1989 | Japan . |
| 1-241728 | 9/1989 | Japan . |
| 1-315924 | 12/1989 | Japan . |
| 2-66828 | 6/1990 | Japan . |
| 2-89753 | 7/1990 | Japan . |
| 2-199735 | 8/1990 | Japan . |
| 5-172050 | 7/1993 | Japan . |
| 5-205608 | 8/1993 | Japan . |
| 5-274995 | 10/1993 | Japan . |
| 6-13043 | 2/1994 | Japan . |
| 6-481149 | 6/1994 | Japan . |
| 720592 | 3/1980 | Russian Federation . |
| 858115 | 1/1961 | United Kingdom . |
| 2197759 | 5/1988 | United Kingdom . |

ONE-PIECE FEMALE BLADE FUSE WITH HOUSING

TECHNICAL FIELD

The present invention relates generally to electrical fuses. More particularly, this invention relates to female electrical fuses which are designed for connection into a fuse block having male terminal connections.

BACKGROUND PRIOR ART

Automobile and other female fuse assemblies commonly comprise a two-piece assembly heretofore having a box-like housing and an all metal one-piece female fuse secured therein. The female fuse has a pair of spaced apart female terminals which are accessible from one end of the housing where male terminal openings are placed in the housing to correspond to male blade-type terminals. The male blade-type terminals or conductors recently, typically extend from a mounting panel or male fuse block, as there has been a shift in the automotive industry toward the use of male terminal blocks. The female terminals are commonly closely encompassed by the housing walls. The female fuse also includes a fuse link extended, usually unsupported, between the female terminals. The connection or transition between the female terminals and the fuse link begins at the center of one female terminal and extends linearly, from a side view, to the other female terminal. At the top of the fuse link, the width of the fuse link, from a top view, is narrowed to create a fuse blowing portion.

Some female fuses use an additional component with the fuse link, such as a ceramic member, for heat conduction purposes to achieve a desired fuse characteristic. The fuse link and additional component are commonly spaced close to the housing side walls for a reduced volume of used material. The above identified two-piece female fuse assembly, with a one piece fuse, is generally disclosed in U.S. Pat. Nos. 4,570,147 , (Ebi), 4,751,490 (Hatagishi), 4,869,972 (Hatagishi), and 4,871,990 (Ikeda et al.). However, there are numerous disadvantages with these and other fuses of this type based on the heretofore mentioned female fuse configurations.

Specifically, when the width of the fuse link is narrowed by cutting into the fuse link, it is very difficult to achieve a width which is consistent across the full length of the fuse blowing portion. The consistency of this width is significant because the width of the fuse blowing portion can be used to control the time delay of the fuse. In addition, the use of a linear fuse link, which starts at the center of the female terminals, limits the length of the fuse link. When linear bends are added to increase the length of the fuse link, a substantial amount of surface area is discarded during manufacture, as disclosed in Ebi listed above. The length of the fuse link is significant, as the length can be used to control the resistance and ,thus, the current rating of the fuse. However, the configuration in Ebi wastes a significant amount of metal during manufacture in order to increase the fuse link length. Furthermore, the use of an additional component with the fuse link, such as a ceramic member, for heat conduction purposes, increases the cost of the materials, and increases the amount of steps of the female fuse assembly.

The present invention is provided to solve these and other problems.

SUMMARY OF THE INVENTION

The present invention is a female fuse assembly. The fuse assembly, among other things, allows for a longer effective length of the fuse link and allows for a uniform reduction in the thickness of the fuse link, for controlling the resistance and time delay of the fuse while at the same time avoiding the above and others problems of previous one-piece female fuses. Generally the female fuse assembly will interrupt a current flowing through a circuit upon certain high current conditions. The circuit will include male terminals that have opposed contact surfaces which connect to female fuse assembly to conduct current through the circuit.

The female fuse assembly includes a female fuse and a housing. The female fuse includes a first and a second female terminal portion each having a face portion which includes a first end, a second end, a first side, and a second side, includes a first clamping arm and a second clamping arm. The female fuse also includes a first bracing arm and a second bracing arm connected to the respective first and second ends of the face portion of first and second female terminal portions. The female fuse further includes a fuse link having a first terminal extension and a second terminal extension connected to the respective first and second female terminal portions. The fuse link has a skived region connected between the first and second terminal extensions at a first transition point and a second transition point, respectively, for controlling the resistance between the first and second female terminal portions. The fuse link further includes a fuse-blowing portion and requires no additional structure for heat insulating the female fuse.

The fuse link further includes a first terminal bend and a second terminal bend. The first terminal bend is positioned substantially toward the second end of the face portion of the first female terminal portion, or vice versa. The second terminal bend is positioned substantially toward the first end of the face portion of the second female terminal portion, or vice versa. This positioning allows for increased length of the fuse link.

The connection between the first female terminal portion and the first terminal extension of the fuse link is positioned substantially toward one end of the face portion of the first female terminal portion. Similarly, the connection between the second female terminal portion and the second terminal extension of the fuse link is positioned substantially toward one end, but not limited to the other end, of the face portion of the second female terminal portion. The present invention can be configured in both a back-to-back or face-to-face arrangement while, at the same time, capturing the features and advantages set forth herein.

Other features and advantages of the invention will be apparent from the following specification taken in conjunction with the following drawing.

DETAILED DESCRIPTION

Figure 1:
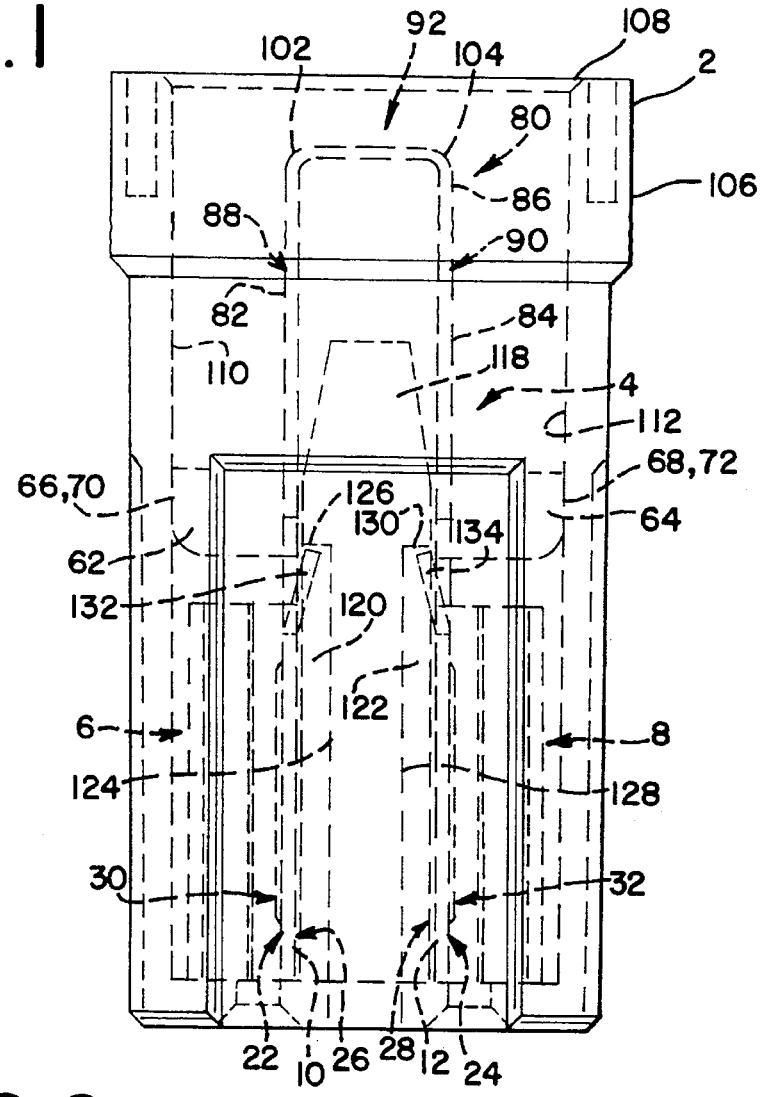
FIG. 1 is a front view of one embodiment of the female fuse assembly of the present invention.
Figure 2:
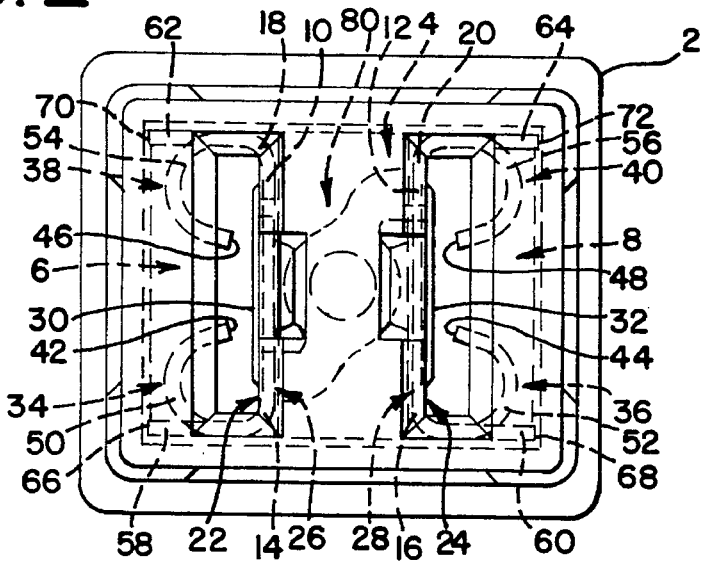
FIG. 2 is a bottom view of the embodiment from FIG. 1 of the present invention.
Figure 3:
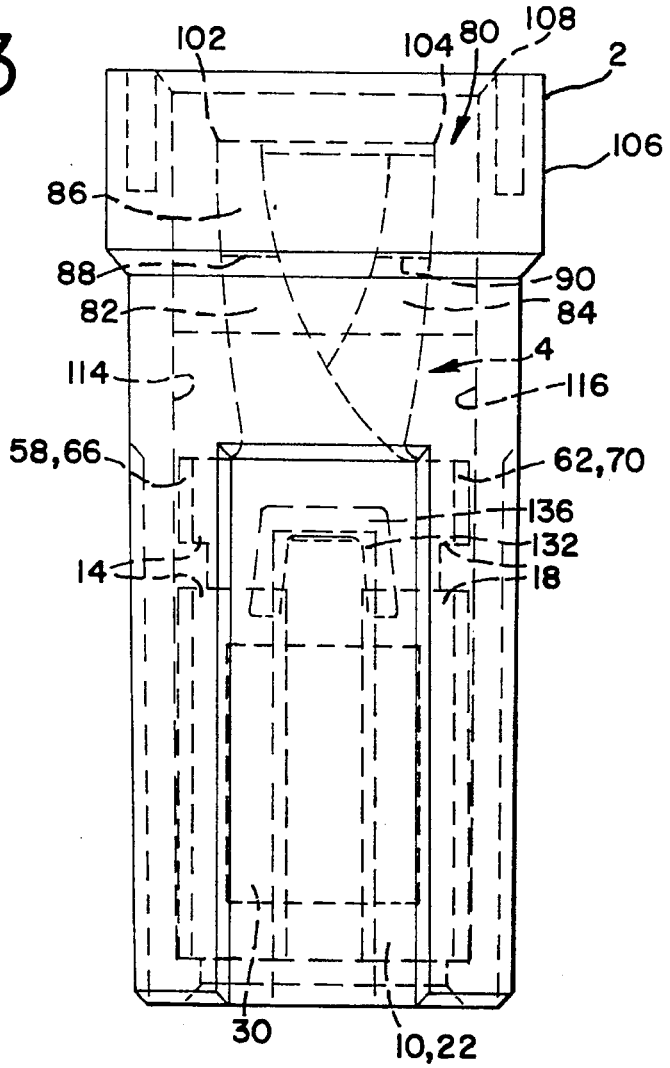
FIG. 3 is a left-side view of the embodiment from FIG. 1 of the present invention.
Figure 4:
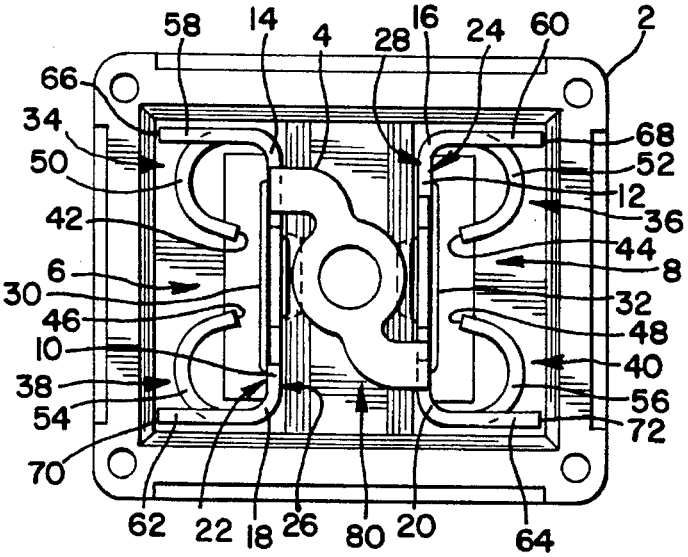
FIG. 4 is top view of the embodiment from FIG. 1 of the present invention.
Figure 5:
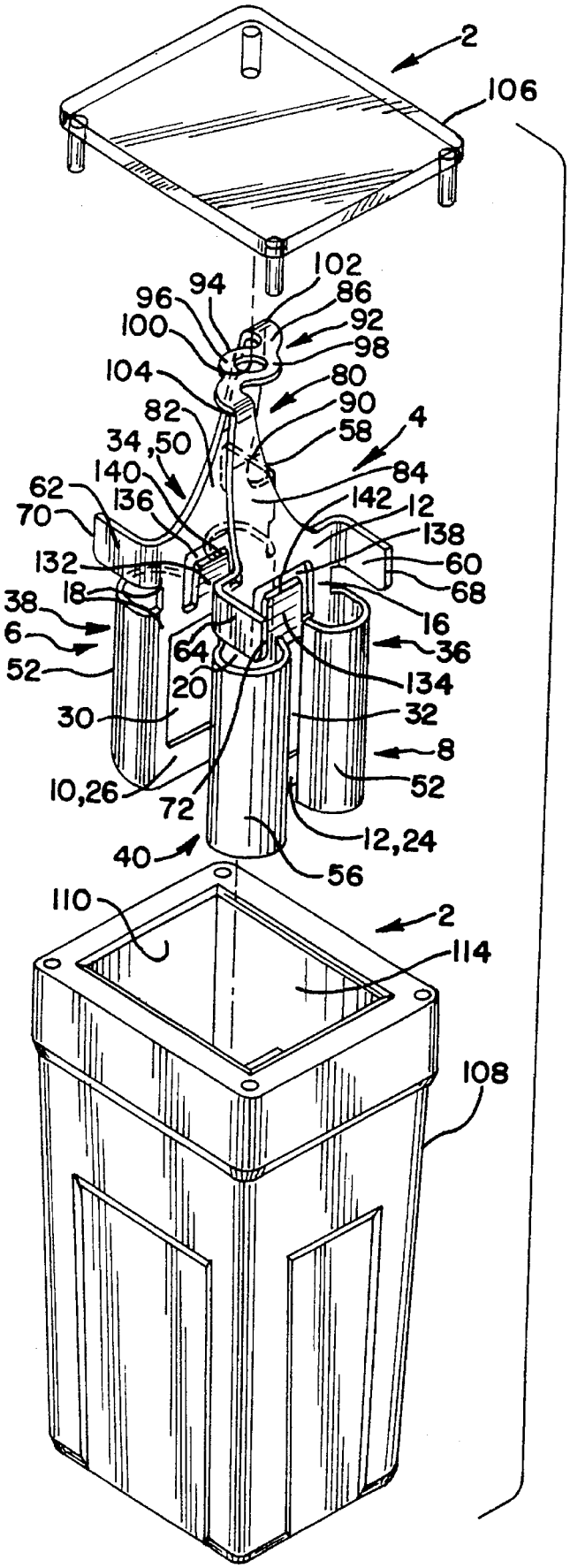
FIG. 5 is an exploded perspective view of the embodiment of FIG. 1 of the present invention.
Figure 6:
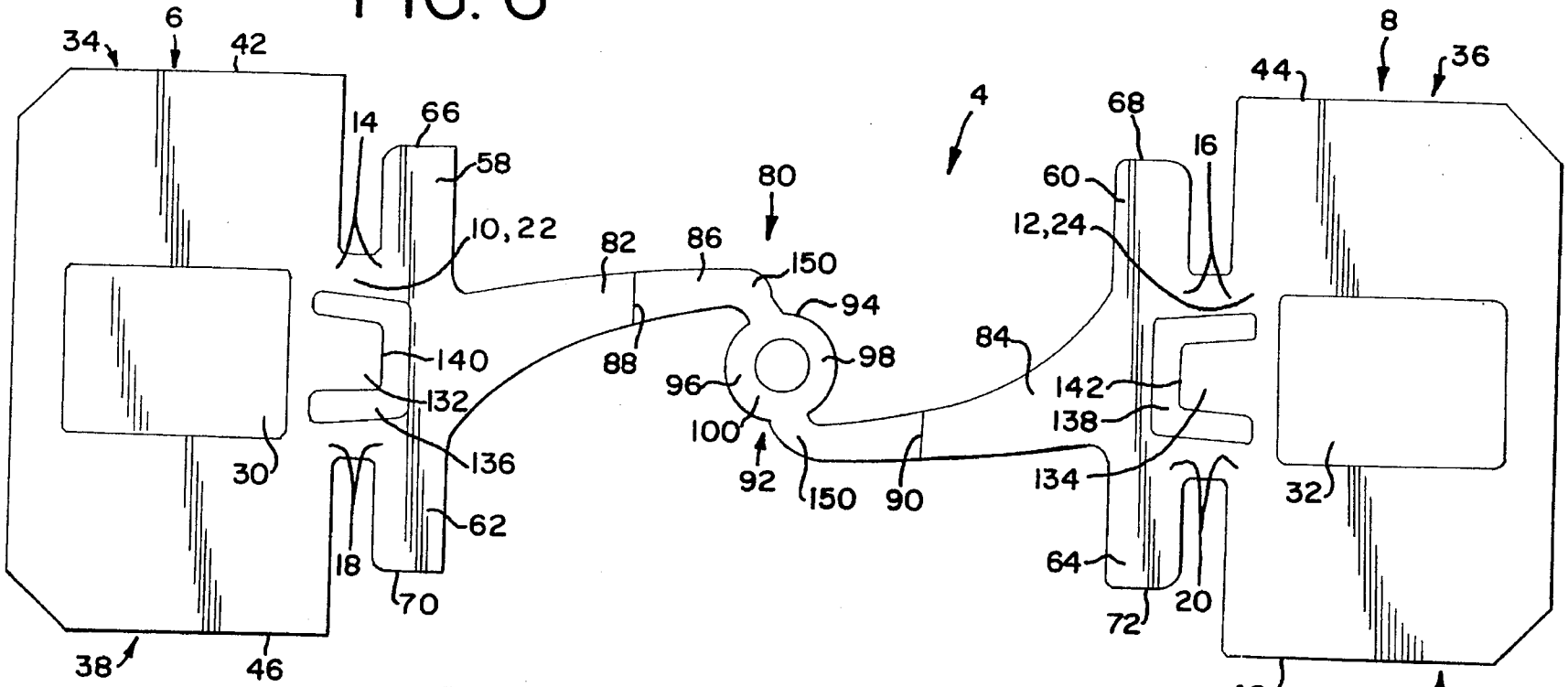
FIG. 6 is a top view of the female fuse embodiment of FIG. 1 of the present invention, in a preformed sheet configuration.
Figure 7:
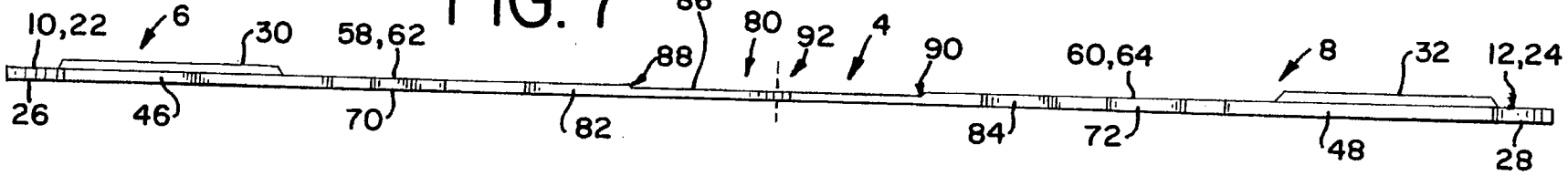
FIG. 7 is a front view of the preformed sheet configuration of the female fuse embodiment from FIG. 6 of the present invention.
Figure 10:
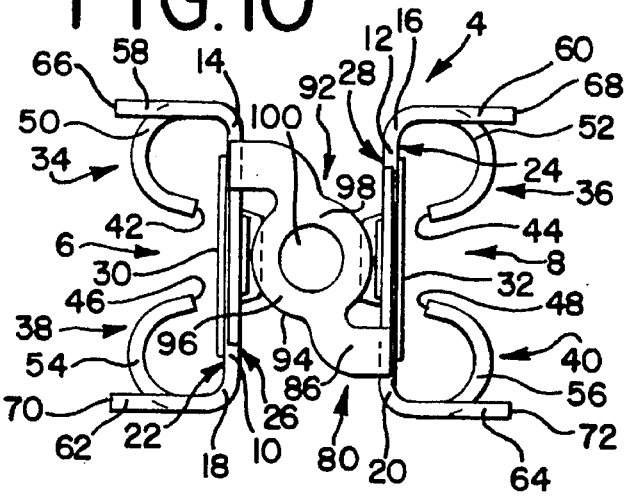
FIG. 10 is top view of the female fuse from FIG. 8 of the present invention.
Figure 8:
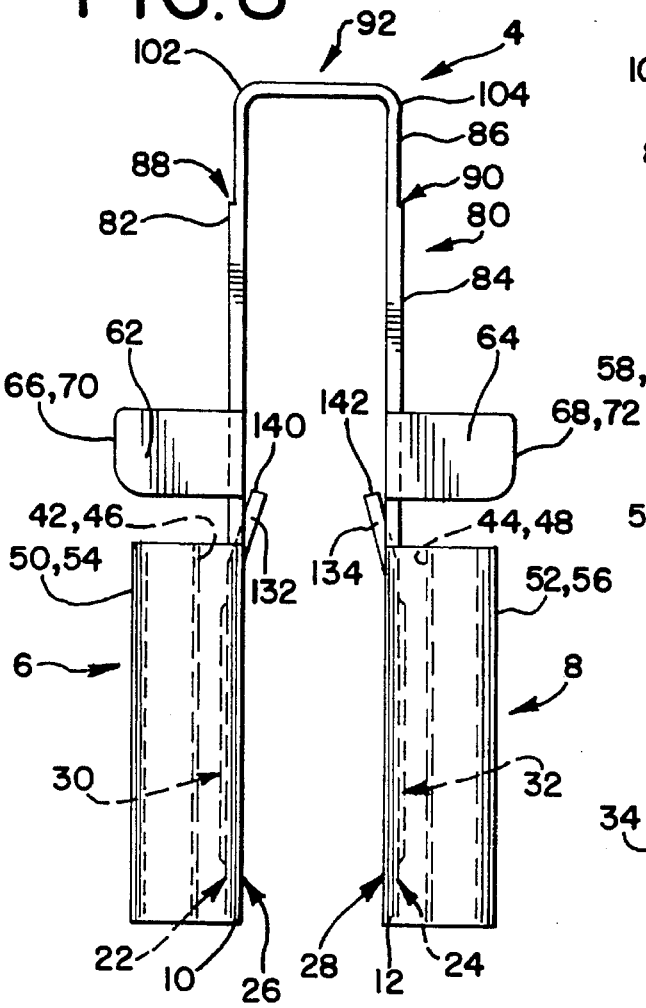
FIG. 8 is a front view of the female fuse from the female fuse assembly of FIG. 1 of the present invention.
Figure 9:
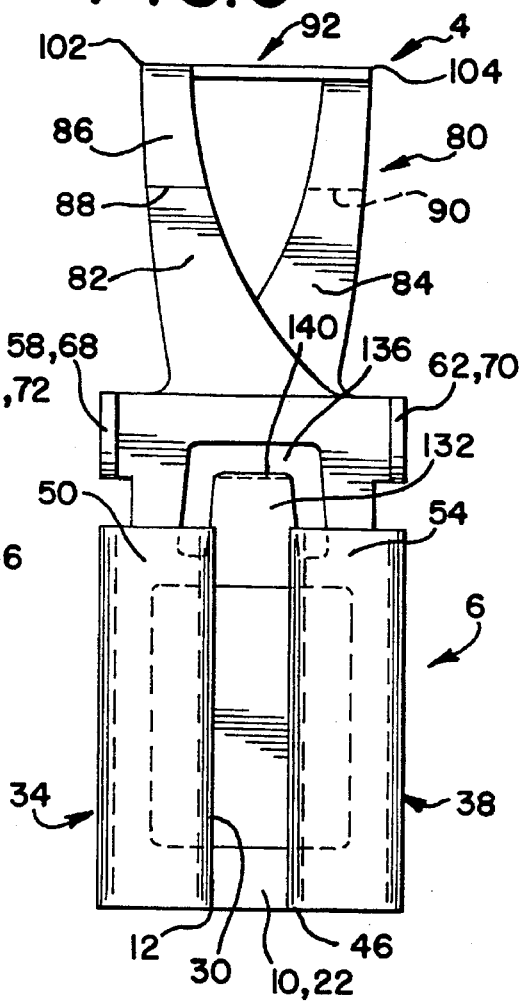
FIG. 9 is a left-side view of the female fuse from FIG. 8 of the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

FIGS. 1 through 5 show a female fuse assembly for interrupting current flowing through a circuit upon certain high current or over current conditions. Numerous occurrences can cause these types of conditions, as is well known in the art. The female fuse assembly is typically placed within a circuit to perform these functions. Specifically, the circuit includes male terminals (not shown) which typically are a part of a male terminal block or fuse block (not shown) for inserting the female fuse assembly onto the male terminal block. Each male terminal has opposed contact surfaces for conductively connecting the female fuse assembly to the rest of the circuit, as will be further described below.

The female fuse assembly of FIGS. 1 through 5 generally includes a fuse housing 2 and a female fuse 4. The female fuse 4, more clearly shown in FIGS. 6 through 10, is made from one continuous sheet of metal, preferably a copper alloy, and several manufacturing steps cuts out and otherwise forms the metal sheet into the embodiment in FIGS. 1 through 5 as will be described further below. The female fuse 4 includes a first female terminal portion 6 and a second female terminal portion 8. The first female terminal portion 6 includes a first face portion 10 and the second female terminal portion 8 includes a second face portion 12. The first and second face portions each include a first end 14, 16, a second end 18, 20, a first side 22, 24, and a second side 26, 28, respectively.

The first side 22 of the first face portion 10 of the first female terminal portion 6 includes a first raised portion 30. The first raised portion 30 is formed by pressing out a rectangular shape into the second side 26 of the first face portion 10. Likewise, the first side 24 of the second face portion 12 of the second female terminal portion 8 includes a second raised portion 32. The second raised portion 32 is again formed by pressing out a rectangular shape into the second side 28 of the second face portion 12. The first and second raised portions 30, 32 are provided on the first and second face portions 10, 12, respectively, for creating a secure engagement with the male terminals. The raised portions are also provided for creating a large surface area of contact between the face portions 10, 12 and the male terminals, to reduce resistance between the female terminal portions 6, 8 and the male terminals.

The female fuse 4 further includes a first clamping arm 34 connected to the first end 14 of the first face portion 10, a first clamping arm 36 connected to the first end 16 of the second face portion 12, a second clamping arm 38 connected to the second end 18 of the first face portion 10, and a second clamping arm 40 connected to second end 20 of the second face portion 12, of the respective first and second female terminal portions 6, 8. The first clamping arm 34 of the first female terminal portion 6 includes a first contact edge 42, and the first clamping arm 36 of the second female terminal portion 8 includes a first contact edge 44. Likewise, the second clamping arm 38 of the first female terminal portion 6 includes a second contact edge 46, and the second clamping arm 40 of the second female terminal portion 8 includes a second contact edge 48. Each of these contact edges 42, 44, 46, 48 generally face and extend toward the respective first side 22, 24 each of the respective first and second female terminal portions 6, 8, after the female fuse 4 is formed during manufacture. These contact edges 42, 44, 46, 48 are provided to engage the male terminals when the male terminals are inserted into the female terminal portions 6, 8. When the male terminals are inserted, the contact edges 42, 44, 46, 48 press against one side of the male terminals, and force the male terminals into effective contact with the respective first and second raised portions 30, 32.

To achieve an effective contact between the male terminals and the respective raised portions 30, 32, each clamping arm includes a semi-circular portion formed at a proper bend, and made of a sufficient resiliency. Specifically, the first clamping arm 34 of the first female terminal portion 6 includes a first resilient semi-circular portion 50, and the first clamping arm 36 of the second female terminal portion 8 includes a first resilient semi-circular portion 52. Likewise, the second clamping arm 38 of the first female terminal portion 6 includes a second resilient semi-circular portion 54, and the second clamping arm 40 of the second female terminal portion 8 includes a second resilient semi-circular portion 56. FIGS. 6, 7, 11, and 12 do not show these semi-circular portions 50, 52, 54, 56 as these portions are created by bending the respective clamping arms 34, 36, 38, 40 toward the first sides 22, 24 of the respective first and second faces 10, 12 of the first and second female terminal portions 6, 8.

The female fuse 4 further includes a first bracing arm 58 connected to the first end 14 of the first face portion 10 of first female terminal portion 6, and a first bracing arm 60 connected to the first end 16 of the second face portion 12 of second female terminal portion 8. Likewise, the female fuse 4 includes a second bracing arm 62 connected to the second end 18 of the first face portion 10 of first female terminal portion 6, and a second bracing arm 64 connected to the second end 20 of the second face portion 12 of second female terminal portion 8. The first bracing arm 58 of the first female terminal portion 6 includes a first bracing edge 66, and the first bracing arm 60 of the second female terminal portion 8 includes a first bracing edge 68. Likewise, the second bracing arm 62 of the first female terminal portion 6 includes a second bracing edge 70, and the second bracing arm 64 of the second female terminal portion 8 includes a second bracing edge 72. The first and second bracing arms, 58, 60, 62, 64 of the respective first and second female terminal portions 6, 8 are arranged substantially perpendicular to the respective first and second face portion 10, 12 of the first and second female terminal portions 6, 8. Thus, the first and second bracing edges 66, 68, 70, 72 extend away from, and perpendicular to, the respective first side 22, 24 of the first and second face portion 10, 12 of the respective first and second female terminal portions 6, 8. The bracing arms 58, 60, 62, 64 and bracing edges 66, 68, 70, 72 are provided for bracing and stabilizing the female fuse 4 within the housing 2, as will be described in greater detail below.

The female fuse 4 additionally includes a fuse link 80. The fuse link 80 includes a first terminal extension 82 and a second terminal extension 84. The first terminal extension 82 is connected to the first female terminal portion 6, and the second terminal extension 84 is connected to the second female terminal portion 8. The fuse link 80 further includes a skived region 86 connected between the first and second terminal extensions 82, 84 at a first transition point 88 and a second transition point 90. The skived region 86 is provided for controlling the resistance between the first and second female terminal portions, as the resistance will vary by changing the thickness of the fuse link 80. During manufacture, skiving takes place before the female fuse 4 is formed. Specifically, the thickness is reduced in a specified area along a full sheet of metal before the sheet of metal is cut or stamped into the female fuses. The reduction of thickness takes place through known reduction techniques, such that the reduced area, or skived regions has a substantially uniform thickness. Skiving creates a more uniform thickness, and thus, a more reliable opening time characteristic as well as other advantages, than does casting, stamping, coining, or other reduction technique.

The fuse link 80 also includes a fuse-blowing portion 92. The fuse-blowing portion 92 includes a ring 94 that has a first branch 96 and a second branch 98, which together form a plug hole 100. A plug (not shown) is placed within the plug hole 100. As described in U.S. Pat. No. 4,635,023 (Oh), entitled "Fuse Assembly Having a Non-Sagging Suspended Fuse Link," which is incorporated herein as a part of the present specification by reference, the fuse-blowing portion 92 of the fuse link 80 includes a hot spot portion or ring 94, and a fuse-blowing current-reducing material or plug (not shown) placed within the plug hole 100. The material used to reduce the opening current within the plug hole 100 is preferably tin, while the overall female fuse 4 is preferably a copper alloy. In addition, the fuse link 80 configuration alleviates the need for any heat conduction member, and requires no additional structure for heat insulating the fuse link 80 or the female fuse 4.

The formed fuse link 80 further includes a first terminal bend 102 and a second terminal bend 104. In one embodiment, the first terminal bend 102 is positioned substantially toward the first end 14 of the first face portion 10 of the first female terminal portion 6, and the second terminal bend 104 is positioned substantially toward the second end 20 of the second face portion 12 of the second female terminal portion 8. In another embodiment of the present invention, the first terminal bend 102 is positioned substantially toward the second end 18 of the first face portion 10 of the first female terminal portion 6, and the second terminal bend 104 is positioned substantially toward the first end 16 of the second face portion 12 of the second female terminal portion 8. The placement of the bends 102, 104 within the female fuse 4 increases the length of the fuse link 80 without requiring the use of any additional volume of metal material to create the female fuse 4. Moreover, increasing the length of the fuse link 80 in this fashion, and in the embodiments described below, actually reduces the amount of material which is discarded during manufacture.

Other configurations for the connections between the female fuse terminals 6, 8 and the terminal extensions 82, 84, will achieve a lengthened fuse link 80 without increasing the volume of material used, as well. Specifically, another embodiment of the present invention includes that the connection between the first female terminal portion 6 and the first terminal extension 82 of the fuse link 80 is positioned substantially toward the first end 14 of the first face portion 10 of the first female terminal portion 6, and includes that the connection between the second female terminal portion 8 and the second terminal extension 84 of the fuse link 80 is positioned substantially toward the first end 16 of the second face portion 12 of the second female terminal portion 8. Another embodiment of the present invention includes that the connection between the first female terminal portion 6 and the first terminal extension 82 of the fuse link 80 is positioned substantially toward the first end 14 of the first face portion 22 of the first female terminal portion 6, and includes that the connection between the second female terminal portion 8 and the second terminal extension 84 of the fuse link 80 is positioned substantially toward the second end 20 of the second face portion 12 of the second female terminal portion 8. Another embodiment of the present invention includes that the connection between the first female terminal portion 6 and the first terminal extension 82 of the fuse link 80 is positioned substantially toward the second end 18 of the first face portion 10 of the first female terminal portion 6, and includes that the connection between the second female terminal portion 8 and the second terminal extension 84 of the fuse link 80 is positioned substantially toward the second end 20 of the second face portion 12 of the second female terminal portion 8. Another embodiment of the present invention includes that the connection between the first female terminal portion 6 and the first terminal extension 82 of the fuse link 80 is positioned substantially toward the second end 22 of the first face portion 10 of the first female terminal portion 6, and includes that the connection between the second female terminal portion 8 and the second terminal extension 84 of the fuse link 80 is positioned substantially toward the first end 16 of the second face portion 12 of the second female terminal portion 8.

One feature which most embodiments have in common is that the fuse link 80 is non-linear. Previous fuses used a fuse link which extended linearly from the first female terminal to the second female terminal when viewed from the side of the fuse (facing a face portion). No lateral curves or bends existed in these previous fuse links from a side view. The present fuse 4 has at least two lateral curved portions 150 which break the linearity of the fuse link 80, for increasing the length of the fuse link 80 without using any additional fuse material during manufacture.

After the female fuse 4 is formed, generally in the shape of the female fuse 4 from FIGS. 1 through 5, and 8 through 10, the female fuse is placed within the housing 2, as shown in FIGS. 1 through 5. The housing 2 includes a main portion 106 and a cap 108. The fuse housing 2 is made of electrically insulating material, such as a synthetic polymer or plastic. The main portion 106 includes a first interior wall 110, a second interior wall 112, a third interior wall 114, and a fourth interior wall 116, a divider 118 extended between the third and the fourth interior walls 114, 116, all defining a space therein. The divider is provided for partially dividing the space, and includes a first interior cut-out portion 120 and a second interior cut-out portion 122. The first interior cut-out portion 120 includes and is defined by a first cut-out side wall 124 and a first cut-out upper wall 126. The second interior cut-out portion 122 includes and is defined by a second cut-out side wall 128 and a second cut-out upper wall 130.

For the purpose of securing the female fuse within main portion 106 of the housing 2, the first female terminal portion 6 includes a first lance 132. The first lance is defined by a first lance cut-out portion 136 on the first face portion 10 of the first female terminal portion 6, and is substantially centered between the first and second ends 14, 18 of the first face portion 10 of the first female terminal portion 6. The first lance 132 includes a first lance edge 140. Likewise, the second female terminal portion 8 further includes a second lance 134. The second lance 134 is defined by a second lance cut-out portion 138 on the second face portion 12 of the second female terminal portion 8, and is substantially centered between the first and second ends 16, 20 of the second face portion 12 of the second female terminal portion 8. The second lance 134 also has a second lance edge 142. When the female fuse 4 is inserted into the main portion 108 of the housing 2, the first lance edge locks into the first interior cut-out portion 120, and engages with the first cut-out upper wall 126. Likewise, the second lance edge 142 locks into the second interior cut-out portion 122, and engages with the second cut-out upper wall 130. The cap 108 of the housing 2 is preferably transparent, and locks into the main portion 108 through well known techniques.

Figure 11:
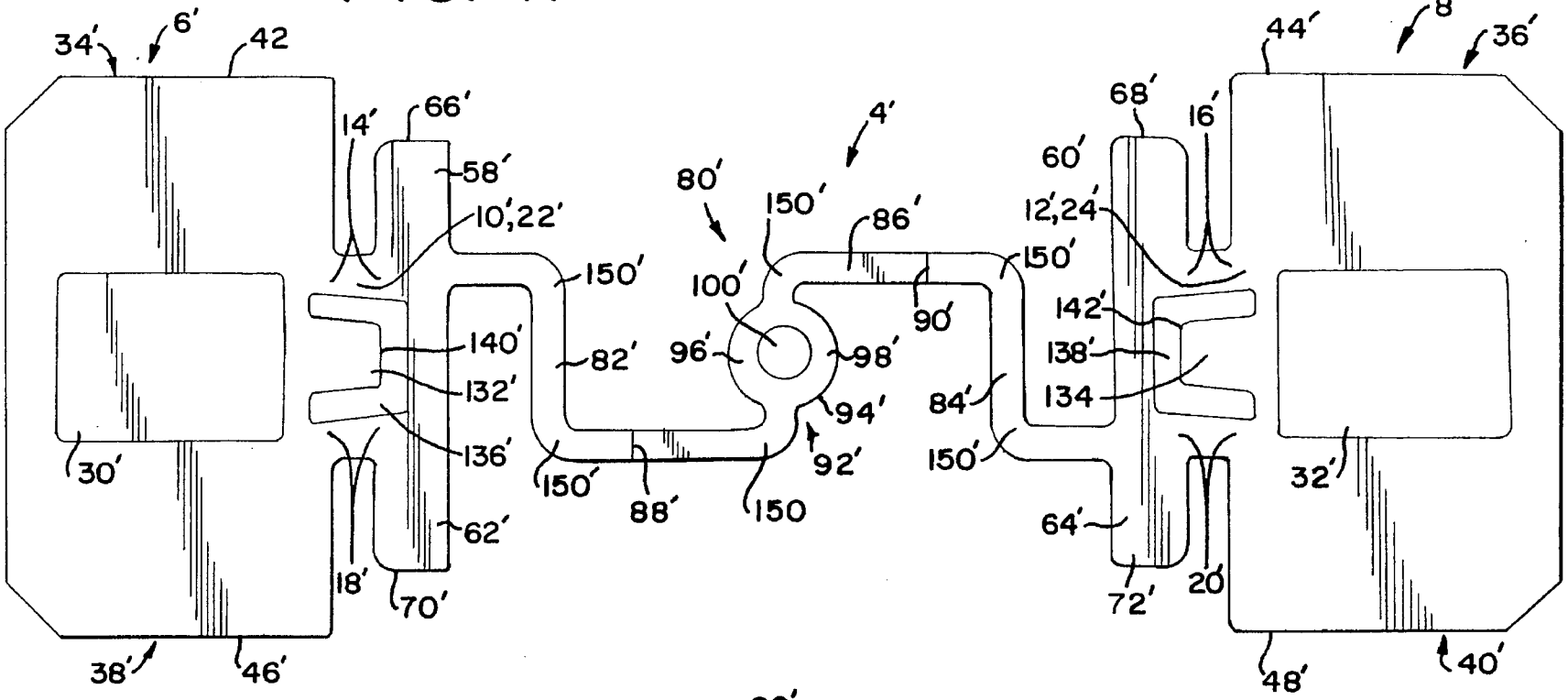
FIG. 11 is a top view of a separate female fuse embodiment of the present invention, in a preformed sheet configuration, similar to FIG. 6.
Figure 12:
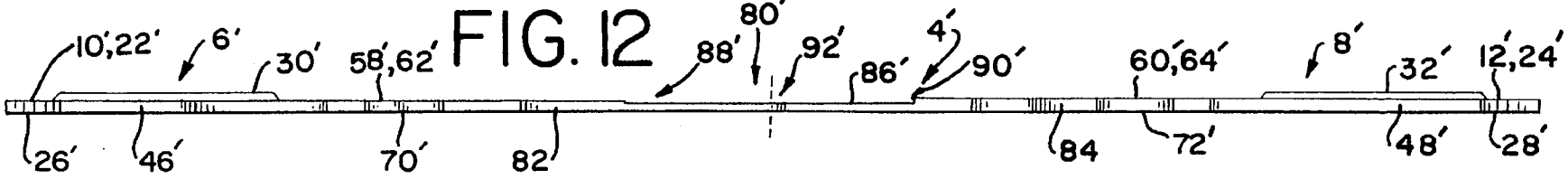
FIG. 12 is a front view of the preformed sheet configuration of the female fuse embodiment from FIG. 11 of the present invention.

On additional specific embodiment of the present invention is shown in FIGS. 11 and 12, and has generally already been described above. However, FIGS. 11 and 12 include reference to several common element numbers with a single prime designation instead.

It will be understood that the invention may be embodied in other specific forms without departing from the spirit or central characteristics thereof, including, but not limited to, the orientations of the invention elements herein to achieve the above identified and other advantages. The present examples and embodiments, therefore, are to be considered in all respects as illustrative and not restrictive, and the invention is not to be limited to the details given herein.

What is claimed is:

1. In a female fuse for interrupting a current flowing through a circuit upon certain high current conditions, a female fuse comprising:

a first and a second female terminal portion each having a face portion which includes a first end margin, a second end margin, a first side, and a second side;

a first clamping arm and a second clamping arm connected to the respective first and second ends of the face portion of the first and second female terminal portions, the first and second clamping arms of the first and second female terminal portions having respective first and second contact edges extending toward the first side of the face portion of the first and second female terminal portions;

a first bracing arm and a second bracing arm having respective first and second bracing edges extending away from the face portion of the first and second female terminal portions; and, a fuse link having a first terminal extension and a second terminal extension connected to the respective first and second female terminal portions, and having a skived region, connected between the first and second terminal extensions at a first transition point and a second transition point, for controlling the resistance between the first and second female terminal portions, the skived region having a substantially uniform thickness, and including a fuse-blowing portion, the fuse link requiring no additional structure for heat insulating the fuse link.

2. The female fuse as claimed in claim 1 wherein the female fuse is made from one continuous sheet of metal.

3. The female fuse as claimed in claim 1 wherein the fuse-blowing portion includes a fuse plug hole, and wherein a plug is placed in the fuse plug hole.

4. The female fuse as claimed in claim 1 wherein the first female terminal portion further includes a first lance, defined by a first lance cut-out portion on the face portion of the first female terminal portion, substantially centered between the first and second ends of the face portion of the first female terminal portion, the first lance having a first lance edge, and wherein the second female terminal portion further includes a second lance, defined by a second lance cut-out portion on the face portion of the second female terminal portion, substantially centered between the first and second ends of the face portion of the second female terminal portion, the second lance having a second lance edge.

5. The female fuse as claimed in claim 1 wherein each first clamping arm of the respective first and second female terminal portions includes a first resilient semi-circular portion, and wherein each second clamping arm of the respective first and second female terminal portions includes a second resilient semi-circular portion.

6. The female fuse as claimed in claim 1 wherein the first side of the face portion of the first female terminal portion includes a first raised portion, and wherein the first side of the face portion of the second female terminal portion includes a second raised portion.

7. The female fuse as claimed in claim 4 further comprising a fuse housing made of electrically insulating material, the housing having space therein, and a divider for partially dividing the space, the divider including a first interior cut-out portion and a second interior cut-out portion, the first interior cut-out portion having a first cut-out side wall and a first cut-out upper wall, the second interior cut-out portion having a second cut-out side wall and a second cut-out upper wall, the first lance edge being engaged with the first cut-out upper wall and the second lance edge being engaged with the second cut-out upper wall when the female fuse is inserted into the space.

8. In a female fuse for interrupting a current flowing through a circuit upon certain high current conditions, a female fuse comprising:

first and second female terminal portions each having a face portion which includes spaced first and second end margins, spaced innermost and outermost margins extending between said first and second end margins, and opposite first and second sides, said face portions of said first and second female portions being in generally, laterally spaced parallel planes, and first and second male terminal clamping arms respectively extending laterally from said face portions of the first and second female terminal portions and forming male terminal-receiving and male terminal-contacting recesses extending in the direction of a longitudinal axis extending between said innermost and outermost margins of said face portions and each having a male terminal-receiving entry opening facing away from said outermost margins of said face portions; and, a fuse link having first and second terminal extension portions respectively connected to and extending longitudinally away from said innermost margins of said face portions of the respective first and second female terminal portions, the first and second terminal extension portions of said fuse link respectively having at least first and second terminal bends, both of which extend in a direction having at least a component parallel to said parallel planes of the face portions of the terminal portions, and a fuse blowing portion extending traversely between said terminal bends, said terminal portions and said fuse link being a single integral piece of metal stampable from a single piece of sheet metal and bent to form at least said clamping arms and the fuse blowing portion of the fuse link.

9. The female fuse as claimed in claim 8 wherein the connection between the first female terminal portion and the first terminal extension of the fuse link is located substantially at the first end margin of the face portion of the first female terminal portion, and wherein the connection between the second female terminal portion and the second terminal extension of the fuse link is located substantially at the first end margin of the face portion of the second female terminal portion.

10. The female fuse as claimed in claim 8 wherein the connection between the first female terminal portion and the first terminal extension of the fuse link is located substantially at the first end margin of the face portion of the first female terminal portion, and wherein the connection between the second female terminal portion and the second terminal extension of the fuse link is located substantially at the second end margin of the face portion of the second female terminal portion.

11. The female fuse as claimed in claim 8 wherein the first female terminal portion further includes a first lance, defined by a first lance cut-out portion on the face portion of the first female terminal portion, substantially centered between the first and second end margins of the face portion of the first female terminal portion, the first lance having a first lance edge, and wherein the second female terminal portion further includes a second lance, defined by a second lance cut-out portion on the face portion of the second female terminal portion, substantially centered between the first and second ends of the face portion of the second female terminal portion, the second lance having a second lance edge.

12. The female fuse as claimed in claim 8 wherein each first clamping arm of the respective first and second female terminal portions includes a first resilient semi-cylindrical portion, and wherein each second clamping arm of the respective first and second female terminal portions includes a second resilient semi-cylindrical portion.

13. The female fuse as claimed in claim 8 wherein the first side of the face portion of the first female terminal portion includes a first raised portion projecting into said recess, and wherein the first side of the face portion of the second female terminal portion includes a second raised portion projecting into said recess.

14. The female fuse as claimed in claim 11 further comprising a fuse housing made of electrically insulating material, the housing having space therein, and a divider for partially dividing the space, the divider including a first interior cut-out portion and a second interior cut-out portion, the first interior cut-out portion having a first cut-out side wall and a first cut-out upper wall, the second interior cut-out portion having a second cut-out side wall and a second cut-out upper wall, the first lance edge being engaged with the first cut-out upper wall and the second lance edge being engaged with the second cut-out upper wall when the female fuse is inserted into the space.

15. In a female fuse assembly for interrupting a current flowing through a circuit upon certain high current conditions, a female fuse comprising:

a first and a second female terminal portion, each having a face portion which includes a first end margin, a second end margin, a first side, and a second side;

a first clamping arm and a second clamping arm connected to the respective first and second end margins of the face portion of the first and second female terminal portions, the first and second clamping arms of the first and second female terminal portions having respective first and second contact edges extending toward the first side of the face portion of the first and second female terminal portions;

a first bracing arm and a second bracing arm having respective first and second bracing edges extending away from the face portion of the first and second female terminal portions; and, a fuse link having a first terminal extension and a second terminal extension connected to the respective first and second female terminal portions, and having a skived region, connected between the first and second terminal extensions at a first transition point and a second transition point, for controlling the resistance between the first and second female terminal portions, the fuse link having a first terminal bend and a second terminal bend, the first terminal bend being positioned substantially toward the second end of the face portion of the first female terminal portion, and the second terminal bend being positioned substantially toward the first end of the face portion of the second female terminal portion, for increasing the length of the fuse link, and the skived region including a fuse-blowing portion.

16. The female fuse assembly as claimed in claim 15 wherein the connection between the first female terminal portion and the first terminal extension of the fuse link is positioned substantially toward the first end of the face portion of the first female terminal portion, and wherein the connection between the second female terminal portion and the second terminal extension of the fuse link is positioned substantially toward the first end of the face portion of the second female terminal portion.

17. The female fuse assembly as claimed in claim 15 wherein the connection between the first female terminal portion and the first terminal extension of the fuse link is positioned substantially toward the first end of the face portion of the first female terminal portion, and wherein the connection between the second female terminal portion and the second terminal extension of the fuse link is positioned substantially toward the second end of the face portion of the second female terminal portion.

18. The female fuse assembly as claimed in claim 15 wherein the connection between the first female terminal portion and the first terminal extension of the fuse link is positioned substantially toward the second end of the face portion of the first female terminal portion, and wherein the connection between the second female terminal portion and the second terminal extension of the fuse link is positioned substantially toward the second end of the face portion of the second female terminal portion.

19. The female fuse assembly as claimed in claim 15 wherein the connection between the first female terminal portion and the first terminal extension of the fuse link is positioned substantially toward the second end of the face portion of the first female terminal portion, and wherein the connection between the second female terminal portion and the second terminal extension of the fuse link is positioned substantially toward the first end of the face portion of the second female terminal portion.

20. The female fuse assembly as claimed in claim 15, 16, 17, 18, or 19 wherein the female fuse is made from one continuous sheet of metal.

21. The female fuse assembly as claimed in claim 20 wherein the fuse-blowing portion includes a fuse plug hole, and wherein a plug is placed in the fuse plug hole.

22. The female fuse assembly as claimed in claim 20 wherein the first female terminal portion further includes a first lance, defined by a first lance cut-out portion on the face portion of the first female terminal portion, substantially centered between the first and second ends of the face portion of the first female terminal portion, the first lance having a first lance edge, and wherein the second female terminal portion further includes a second lance, defined by a second lance cut-out portion on the face portion of the second female terminal portion, substantially centered between the first and second ends of the face portion of the second female terminal portion, the second lance having a second lance edge.

23. The female fuse assembly as claimed in claim 21 wherein the first female terminal portion further includes a first lance, defined by a first lance cut-out portion on the face portion of the first female terminal portion, substantially centered between the first and second ends of the face portion of the first female terminal portion, the first lance having a first lance edge, and wherein the second female terminal portion further includes a second lance, defined by a second lance cut-out portion on the face portion of the second female terminal portion, substantially centered between the first and second ends of the face portion of the second female terminal portion, the second lance having a second lance edge.

24. The female fuse assembly as claimed in claim 20 wherein each first clamping arm of the respective first and second female terminal portions includes a first resilient semi-circular portion, and wherein each second clamping arm of the respective first and second female terminal portions includes a second resilient semi-circular portion.

25. The female fuse assembly as claimed in claim 21 wherein each first clamping arm of the respective first and second female terminal portions includes a first resilient semi-circular portion, and wherein each second clamping arm of the respective first and second female terminal portions includes a second resilient semi-circular portion.

26. The female fuse assembly as claimed in claim 23 wherein each first clamping arm of the respective first and second female terminal portions includes a first resilient semi-circular portion, and wherein each second clamping arm of the respective first and second female terminal portions includes a second resilient semi-circular portion.

27. The female fuse assembly as claimed in claim 21 wherein the first side of the face portion of the first female terminal portion includes a first raised portion, and wherein the first side of the face portion of the second female terminal portion includes a second raised portion.

28. The female fuse assembly as claimed in claim 21 wherein the first side of the face portion of the first female terminal portion includes a first raised portion, and wherein the first side of the face portion of the second female terminal portion includes a second raised portion.

29. The female fuse assembly as claimed in claim 23 wherein the first side of the face portion of the first female terminal portion includes a first raised portion, and wherein the first side of the face portion of the second female terminal portion includes a second raised portion.

30. The female fuse assembly as claimed in claim 26 wherein the first side of the face portion of the first female terminal portion includes a first raised portion, and wherein the first side of the face portion of the second female terminal portion includes a second raised portion.

31. The female fuse assembly as claimed in claim 30 further comprising a fuse housing made of electrically insulating material, the housing having space therein, and a divider for partially dividing the space, the divider including a first interior cut-out portion and a second interior cut-out portion, the first interior cut-out portion having a first cut-out side wall and a first cut-out upper wall, the second interior cut-out portion having a second cut-out side wall and a second cut-out upper wall, the first lance edge being engaged with the first cut-out upper wall and the second lance edge being engaged with the second cut-out upper wall when the female fuse is inserted into the space.

32. In a female fuse assembly for interrupting a current flowing through a circuit upon certain high current conditions, a female fuse comprising:

a first and a second female terminal portion each having a face portion which includes a first end, a second end, a first side, and a second side;

a first clamping arm and a second clamping arm connected to the respective first and second ends of the face portion of the first and second female terminal portions, the first and second clamping arms of the first and second female terminal portions having respective first and second contact edges extending toward the first side of the face portion of the first and second female terminal portions;

a first bracing arm and a second bracing arm having respective first and second bracing edges extending away from the face portion of the first and second female terminal portions; and, a fuse link having a first terminal extension and a second terminal extension connected to the respective first and second female terminal portions, and having a skived region, connected between the first and second terminal extensions at a first transition point and a second transition point, for controlling the resistance between the first and second female terminal portions, the fuse-link being non-linear and having at least two lateral curved portions, for increasing the length of the fuse link, and the skived region including a fuse-blowing portion.

33. A female fuse for interrupting a current flowing through a circuit upon certain high current conditions, comprising:

first and second female terminal portions each having a face portion which includes spaced first and second end margins, spaced innermost and outermost margins extending between said end margins and opposite first and second sides, first and second clamping arms respectively extending laterally from said face portions of the first and second female terminal portions and forming male terminal-receiving and contact-forming recesses extending in the direction of a longitudinal axis extending between said innermost and outermost margins of said face portions and each having a male terminal-receiving entry opening facing away from said outermost margins of said face portions;

a fuse link having first and second terminal extension portions respectively connected to and extending longitudinally away from said innermost margins of said face portions of the respective first and second female terminal portions, the first and second terminal extension portions of said fuse link each having longitudinally spaced first and second terminal bends, both bends extending in a direction having at least a component parallel to said parallel planes of the face portions of said female terminal portions, and a fuse blowing portion extending transversely between the outermost of said terminal bends.

34. The female fuse of claim 33 wherein the entire fuse is made of a single integral piece of metal stampable from a single piece of sheet metal and bent to form at least said clamping arms and fuse blowing portion of the fuse link.

35. A one piece fuse-forming metal body formable into a fuse having first and second male terminal-receiving and contact-forming female terminal portions and a fuse link having first and second terminal extensions extending from the innermost margins of said female terminal portions, said one piece metal body having all portions initially in a common plane so as to be stampable from a single flat piece of sheet metal, said body comprising:

spaced first and second female terminal-forming portions respectively having face portions each of which includes first and second end margins, innermost and outermost margins extending between said first and second end margins, and opposite first and second sides, and first and second clamping arm-forming portions extendable laterally from said opposite face portions of the first and second female terminal portions so as to form a male terminal-receiving and contact-forming recess extending in the direction of a longitudinal axis extending between said innermost and outermost margins of said face portions and a male terminal-receiving entry opening facing away from said outermost margins of said face portions; and a fuse link having first and second terminal extension portions respectively connected to and extending longitudinally away from said innermost margins of said face portions of the respective first and second female terminal portions, the first and second terminal extension portions of said fuse link respectively having at least first and second terminal bends, both of which extend in a direction having at least a component in a direction transverse to said longitudinal axis extending between the innermost and outermost margins of said face portions, and a fuse blowing portion extending between said first and second terminal bends.

36. The one piece fuse-forming metal body of claim 35 wherein each of said fuse link terminal extension portions have only a single terminal bend.

37. The one piece fuse-forming metal body of claim 35 wherein each of said fuse link terminal extension portions has a second terminal bend longitudinally spaced from the previously mentioned bend in the direction of the female terminal portions thereof, which second bend extends in a direction having a component at least transverse to said longitudinal axis extending between said innermost and outermost margins of said face portions of said female terminal portions.

38. The fuse or one piece fuse-forming metal body of claims 8, 33 or 35 wherein at least said fuse blowing portion of the fuse link is a thinned or skived portion of the fuse link.

39. The fuse or one piece fuse-forming metal body of claims 8, 33 or 35 wherein said first and second terminal bends are formed by bends extending in opposite directions.

40. The fuse or one piece fuse-forming metal body of claims 33 or 35 wherein the second terminal bend in each of said first and second fuse link terminal extensions respectively bend in opposite directions.

* * * * *

UNITED STATES PATENT AND TRADEMARK OFFICE

CERTIFICATE OF CORRECTION

PATENT NO. : 5,581,225

DATED : December 3, 1996

INVENTOR(S) : Seibang Oh, James J. Beckert, Theodore W. Humphrey, William P. Hendrickson It is certified that error appears in the above-indentified patent and that said Letters Patent is hereby corrected as shown below:

Column 7, line 29, please delete "On" and insert -- One--

Signed and Sealed this

Twenty-second Day of April, 1997

Bruce Lehman

*Attest:*

BRUCE LEHMAN

*Commissioner of Patents and Trademarks*

*Attesting Officer*

--